United States Patent [19]

Keel et al.

[11] Patent Number: 4,576,019

[45] Date of Patent: Mar. 18, 1986

[54] CIRCULAR KNITTING MACHINE HAVING IMPROVED TAKE-DOWN APPARATUS

[75] Inventors: Frederick Keel; Keith G. Townsend; Marshall C. Carter, all of Leicester, United Kingdom

[73] Assignee: Bentley Engineering Company Limited, Leicester, England

[21] Appl. No.: 639,795

[22] Filed: Aug. 13, 1984

[30] Foreign Application Priority Data

Aug. 27, 1983 [GB] United Kingdom ..... 8323128

[51] Int. Cl.[4] ..... D04B 15/92

[52] U.S. Cl. ..... 66/147; 66/149 S; 66/153

[58] Field of Search ..... 66/147, 149 R, 149 S, 66/152, 153

[56] References Cited

U.S. PATENT DOCUMENTS 3,430,464 3/1969 Mazzi ..... 66/153
4,142,384 3/1979 Wood ..... 66/149 S

FOREIGN PATENT DOCUMENTS 2037329 7/1980 United Kingdom ..... 66/147

*Primary Examiner*—Wm. Carter Reynolds

[57] ABSTRACT

A circular knitting machine has a take-down mechanism with a pair of sequentially reciprocable annular resilient members (4) movable alongside a take-down throat (31) internally of needles (14) in a cylinder (18).

Annularly arranged cams (20,21) reciprocate the members (4) while rotating concentrically but separately of the cylinder (18). The cams (20,21) are driven by gears (22,24) to rotate at a speed lower than the cylinder (18) to give a surprisingly improved take-down effect.

10 Claims, 7 Drawing Figures

CIRCULAR KNITTING MACHINE HAVING IMPROVED TAKE-DOWN APPARATUS

FIELD OF THE INVENTION

The invention relates to knitting machines with improved take-down mechanisms and in particular to double cylinder machines especially those having upward draw-off.

BACKGROUND

U.S. Pat. No. 4,142,384, assigned to the assignee of the present invention describes a knitting machine having a fabric take-down mechanism for upward fabric draw-off. The operating cams were fixed and springs pulled down rubber cups onto the fabric. The cups are reciprocated against a smooth shallow throat inside the needles. The term "take-down" refers to the removal of the fabric away from the needles whether in an upward or downward direction.

It is amongst the aims of the invention to provide an improved take-down mechanism for double cylinder machines.

SUMMARY OF INVENTION

According to the invention there is provided a circular knitting machine having a take-down mechanism with a pair of sequentially reciprocable annular resilient members movable inside a take-down throat internally of needles in a needle cylinder in which circumferentially arranged cams for reciprocating the members are mounted for rotation concentric with but separately from the needle cylinder and the cams are driven to rotate at a speed lower than the needle cylinder. By rotating the cams more slowly than the needle cylinder the take-down action can be controlled to a greater degree, permitting with suitable design, surprising benefits. It has been found for example that when rotating the cams at half the needle cylinder speed, a cycle comprising one downward and one upward movement can be permitted for each take-down resilient member lasting one revolution of a needle cylinder, providing efficient take-down even at high knitting speeds.

Preferably the throat has an annular shouldered surface with steeply inclined portions spaced by a shoulder facing the respective annular members. By using separate, steeply inclined portions for each resilient take-down member, each member can be made to tension fabric over a prolonged period (such as half a needle cylinder revolution). By using the step, the inner member can meet the throat earlier, reducing the length of fabric between the member and the needles and the effect of the elasticity of such fabric on the take-down action.

Most advantageously the members are connected to concentric sleeves which are in turn keyed to the needle cylinder and each other, the sleeves are connected to a pair of diametrically opposed followers, the cams consist of a pair of diametrically opposed lobes, and the followers are urged downwards onto the cams by gravity. By using gravity, even tension can be imparted to the fabric even through the resilient take-down member is in contact with the fabric whilst it slides over a steep throat part. The gravitational effect can be adjusted by weights. Preferably the members are continuous annular cups to ensure that an uninterrupted line of fabric is engaged.

Other refinements of the invention will emerge from the particular description, but the invention permits efficient take-down with upward draw-off at high knitting speeds. Alternatively, downward draw-off could be effected without any air-suction with the completed knitted articles dropping downwards through a take-down tube in a bottom cylinder under their own weight.

DRAWINGS

PARTICULAR DESCRIPTION

Figure 2A:
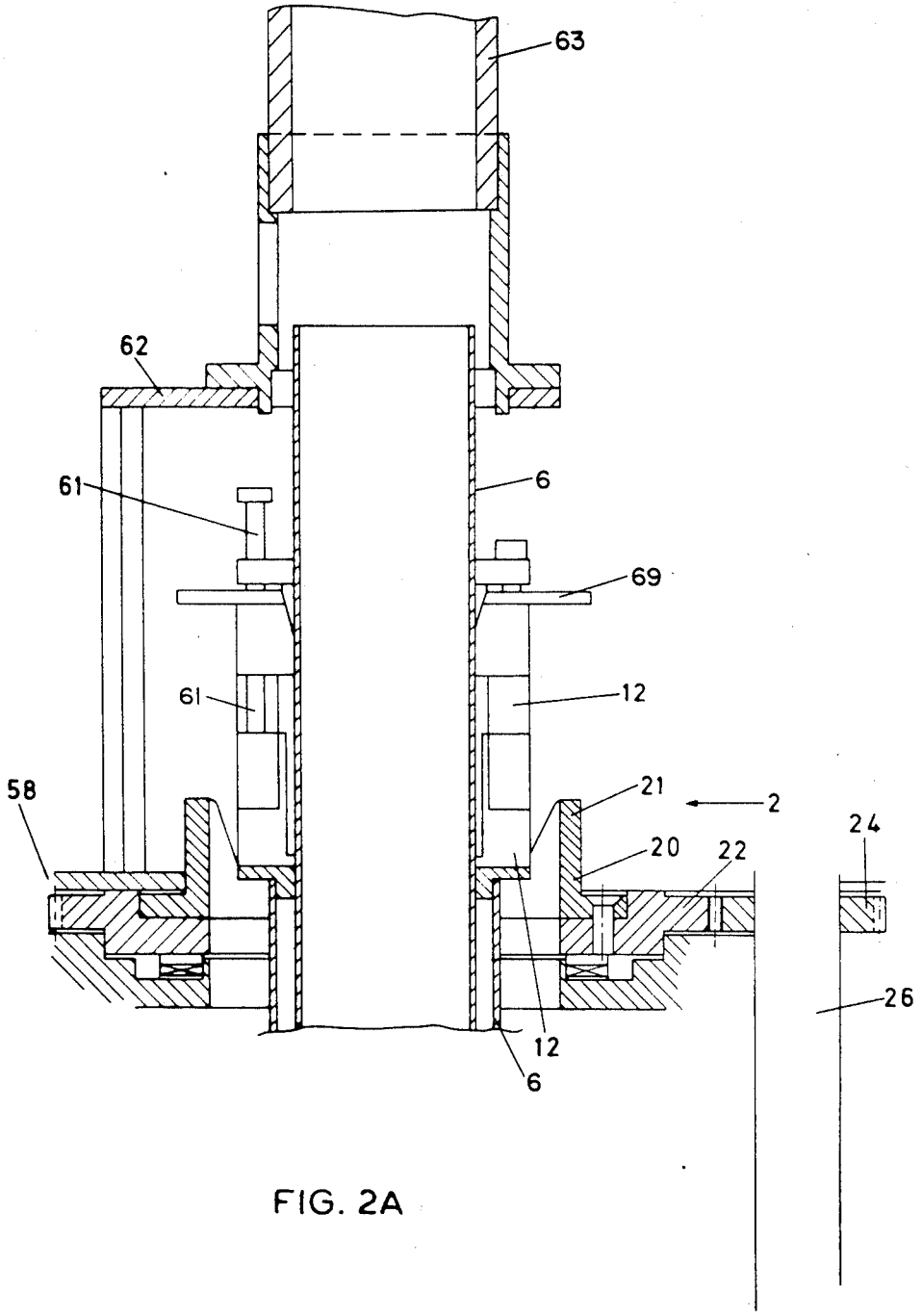
FIGS. 2A and 2B shows a vertical section through an upper and lower part of a knitting head of the knitting machine respectively including also the take-down mechanism of FIG. 1.
Figure 2B:
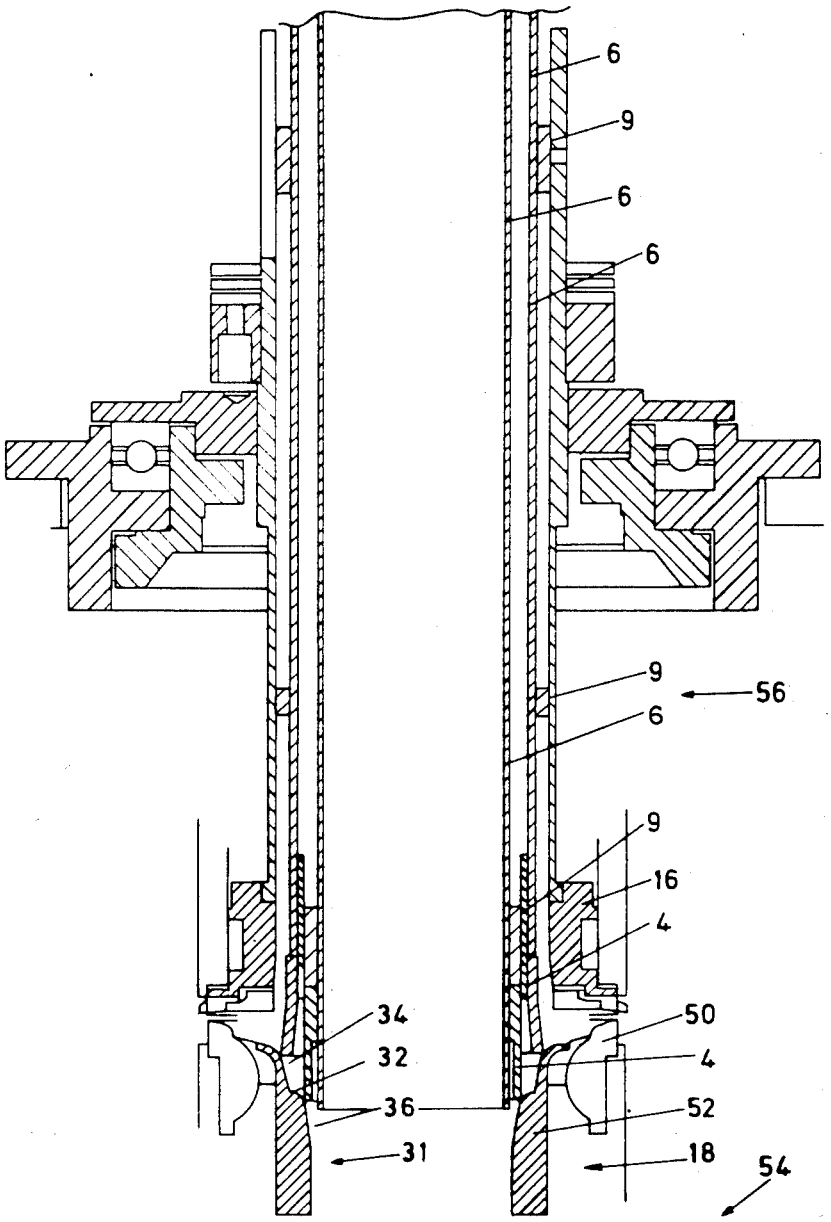

With reference particularly to FIGS. 2A and 2B, the general build-up of a knitting machine with a take-down mechanism according to the invention is as follows:

A bottom cylinder is generally indicated at 18. This cylinder is rotated and with it is rotated a sinker ring generally indicated at 50 and a take-down tube 52 with a throat area 31.

Figure 1:
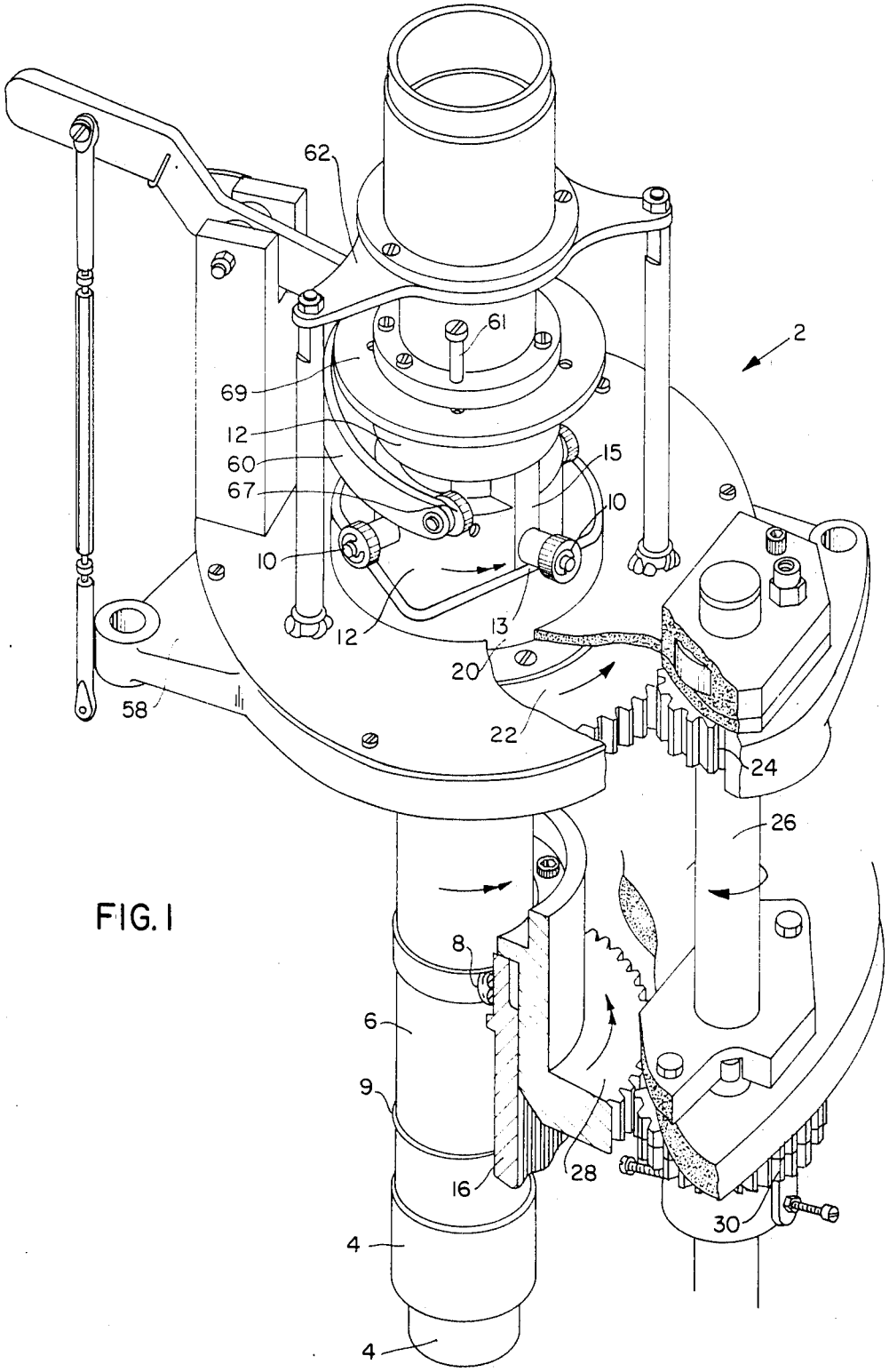
FIG. 1 shows a partly cut-away perspective view of a take-down mechanism of a knitting machine according to the invention.

A top cylinder 16, aligned with the bottom cylinder 18 is rotatable conjointly with the bottom cylinder 18 by means of a back shaft 26 which rotates the top cylinder 16 through a drive gear 30 on the back shaft 26 and a gear 28 fastened to the top cylinder 16 (see FIG. 1).

Both bottom and top cylinders are surrounded by cam systems fixed at 54 and 56 which operate sliders in the tricks of the cylinders as the cylinders rotate. Double ended latch needles (not shown) are manipulated by the sliders to knit in the appropriate pattern by sliding them up and down in the tricks. The needles pass between the sinkers and are radially outwards of the throat 31.

With reference now also to FIG. 1, a take down mechanism for the above briefly described knitting machine is generally indicated at 2. The mechanism 2 includes a pair of resilient annular rubber members or cups 4 which are located coaxially with the cylinders 16 and 18. The cups 4 face the throat 31 at their lower end. The cups 4 are connected to coaxial sleeves 6 extending upwardly inside the top cylinder 16, the innermost one of which forms a smooth fabric guide tube for removing fabric upwardly. The outer sleeve 6 is located in an axially reciprocatory but non-rotatable manner to the top cylinder 16 by keys 8. The sleeves 6 are mutually spaced during their reciprocatory movement by spacer rings 9.

Each of the sleeves 6 carries a member 12. Each member 12 supports a pair of diametrically opposed cam followers 10 in the form of rollers rotatable about axes extending radially with respect to the sleeves 6. The members 12 have matching recesses 13 and projections 15 to prevent relative rotation between sleeves 6 whilst permitting their independent reciprocatory movement. The recesses 13 and projections 15 also permit all of the cam followers 10 to be located substantially at a common level. Thus as the top cylinder 16 is rotated the concentric sleeves 6 are compelled to partake in the rotary movement by the keys 8 and the interengaging recesses 13 and projections 15.

A plate 58 fixed to the frame of the knitting machine mounts an annualar gear 22 surrounding the concentric sleeves 6 below the level of the cam followers 10. The back shaft 26 mounts a drive gear 24 which engages the gear 22. The gear 22 mounts an annular cam ring 20 with a pair of diametrically opposed cam lobes 21 (FIG. 2A) of substantially symmetrical appearance. The gears could be replaced by belts or chains if appropriate.

Figure 6:
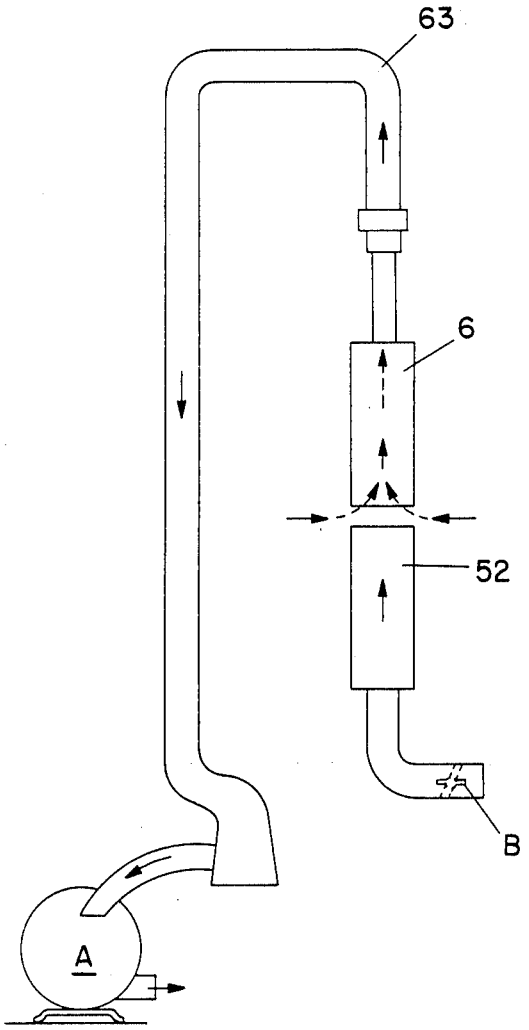
FIG. 6 is a schematic diagram which illustrates the use of suction for removing knitted fabric upwardly through the taken-down mechanism of FIGS. 1–5.

The plate 58 also mounts a yoke 60 capable of lifting both sleeves 6 simultaneously through an elongated screw 61 which is slidable through the upper of the members 12 and is fastened to the lower of the members 12. When the rollers 67 carried by yoke 60 engage an annular flange 69, the upper member 12 hits ahead of screw 61 whereafter both of members 12 and sleeves 16 will be lifted simultaneously so as to disengage the cam followers 10 from the cam ring 20 and interrupt the operation of the take-down mechanism 2. The plate 58 also supports an adaptor bracket 62 for mounting ducting 63 so as to permit suction to be applied to the inside of the tube 7 and remove knitted articles upwardly by means of a suction producing device A which is typically a fan. A valve B controls the suction (see FIG. 6).

The throat 31 has a step 32 extending substantially horizontally, which spaces an upper throat surface 34 and lower throat surface 36 which both are oriented at an acute angle with respect to the cylinder axis and thus form conical wall portions. The upper surface 34 faces the lower end of the outer cup 4 whereas the lower surface 36 faces the lower end of the inner cup 4. On a prototype 3-feed machine of 4 inch diameter medium gauge, the acute angle was between 5 and 20 degrees.

The transmission ratios between the back shaft 26 and the top cylinder 16 on the one hand, and the back shaft 26 and the annular gear 22 on the other hand, are set in such a way that the cam ring 20 rotates once for every two rotations of the top cylinder 16. The height of the cam lobes 21 is set so that both cups can move clear of their respective throat surfaces 34 and 36. The lobes 21 permit each of the cups to be lowered to substantially the same extent along the length of the acutely sloped portion of the throat 31. It should be noted that there are no springs pulling the sleeve 6 and the cups attached in the downwards direction against the cam ring 20. Both sleeves 6 are urged downards by gravity only and their weight has to be selected so that it easily outweighs any frictional resistance to movement of the sleeves 6. For the purpose of the present description, it can be assumed that the cups 4 rest freely on any fabric extending from the needles over the throat 31 under the weight of the sleeves 6 and the members 12. A downward travel of up to $\frac{3}{4}$ of an inch (19 mm) can be permitted by the descending portions of the cam lobes 21 of the cam ring 20.

Figure 3:
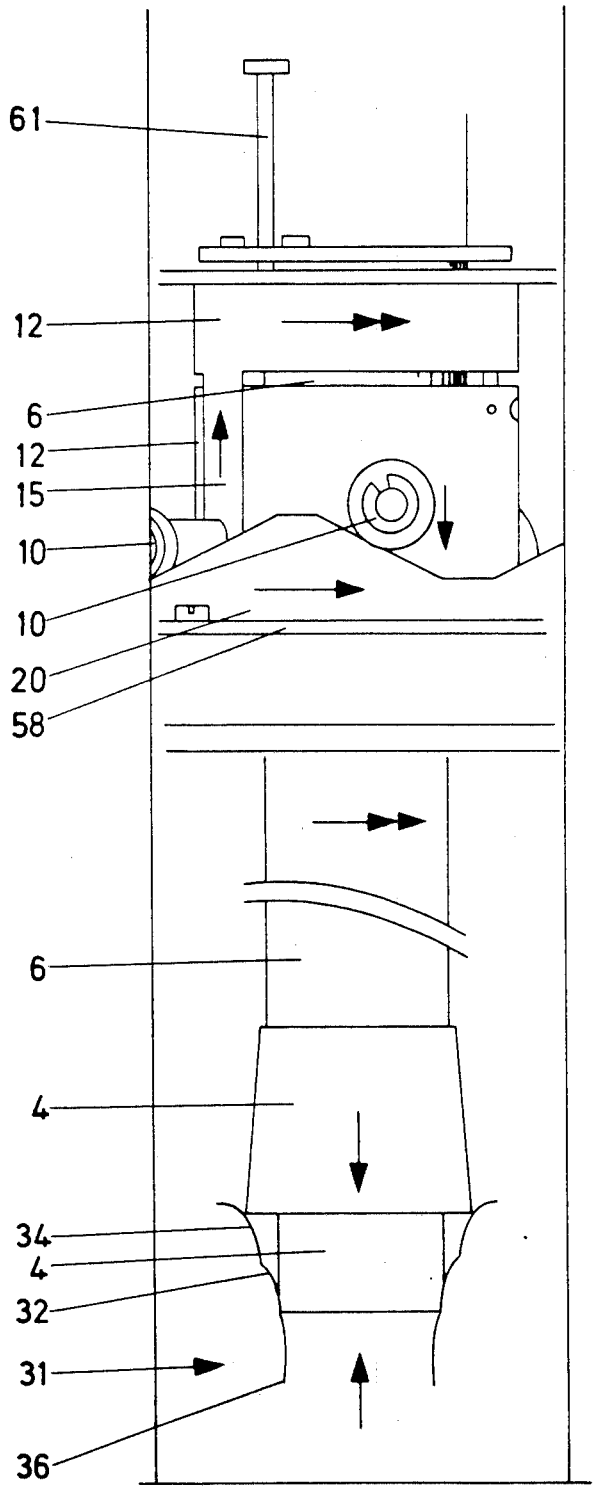
FIGS. 3 to 5 show schematically successive stages of operation of the take down mechanism of FIG. 1.
Figure 4:
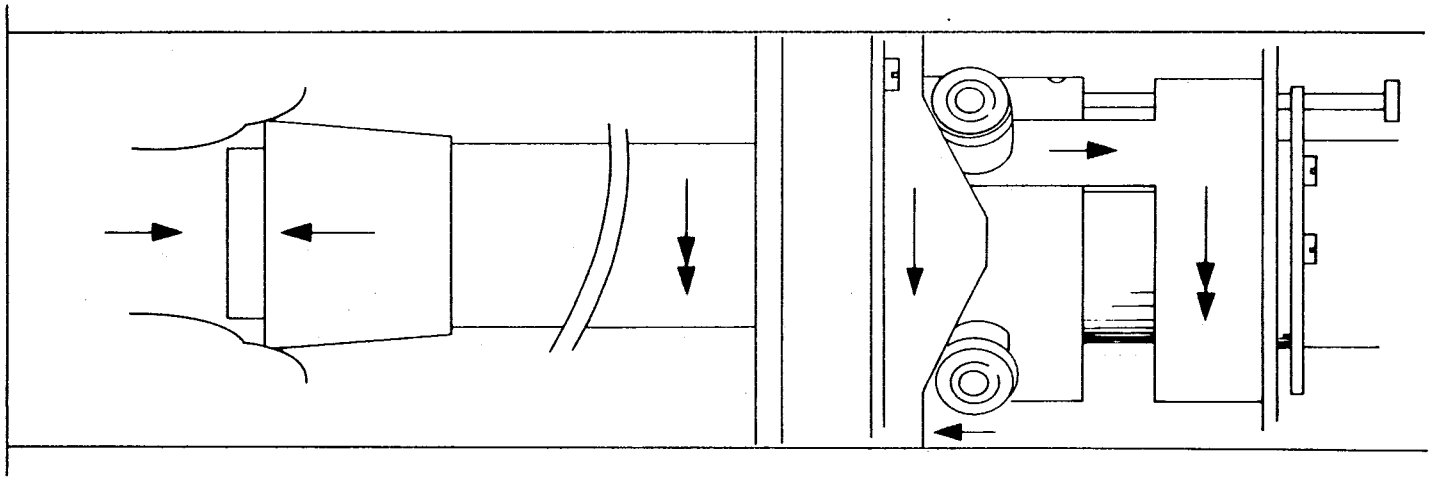
Figure 5:
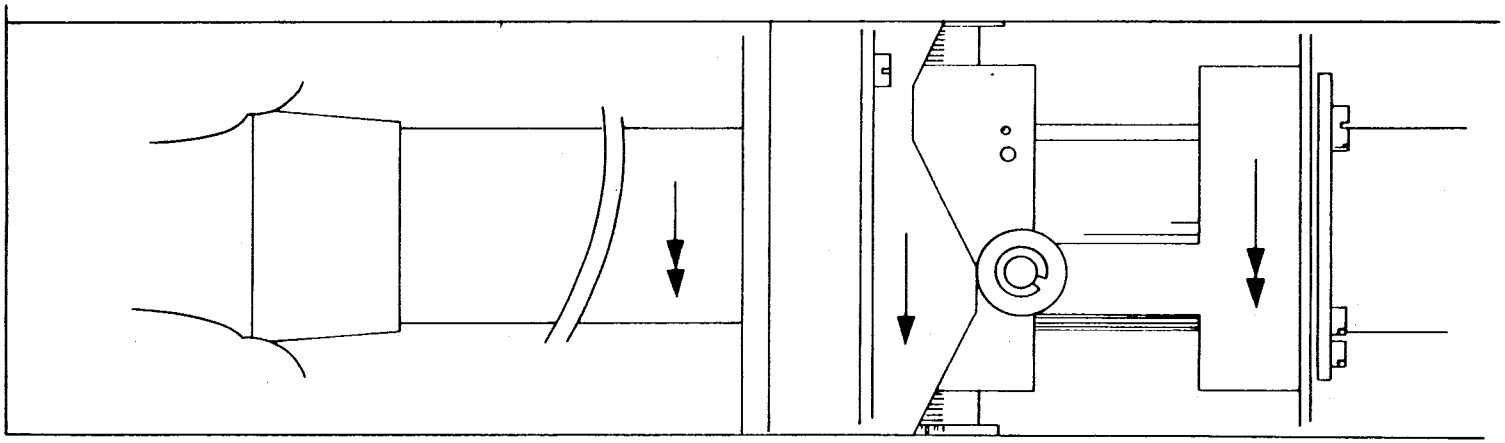

With reference now to FIGS. 3, 4 and 5, during successive stages of operation suction is applied to the top end of the tube 7. As one sleeve 6 rises, the other sleeve 6 is capable of being lowered and so one of the sleeves 6 is exerting a downward pressure on knitted fabric extending from the needles at all times. Both cups 4 of the sleeves 6 engage the fabric for a similar period of time.

Both cups 4 thus contribute to take-down in an equivalent manner and it is not the case, as previously, that the inner cup is lowered to a considerable degree whilst the outer cup merely holds the fabric in place. Both cups just clear the fabric at the top of their upward movement. In use neither associated set of followers bottoms out so suggesting that a gravity take-down force is maintained efficiently for an extended period.

It is believed that the take-down mechanism described exerts a more even take-down tension for a longer period of time and with a reduced strain on the drive mechanism. In comparison with previously known take-down mechanisms, whilst the frequency of the reciprocatory movement of the sleeves 6 has been halved, an efficient take-down effect can be obtained even if the stroke of the sleeves 6 is increased by a marginal extent. By halving the frequency of the stroke and increasing the stroky by say 50 percent a take-down mechanism results which can operate efficiently even at elevated knitting speeds.

Although the inside cup 4 engages the fabric at a considerable distance from the needles and stretches the fabric proportionately before exerting an effective take down pull at the needles, it nevertheless has a sufficiently long stroke to be effective for take down. The outer cut 4 becomes effective more quickly and can maintain its effectiveness as a result of the steep throat angle facing it.

The surprising improvements in take down efficiency can be achieved with a mechanism which is only marginally more complicated than the known take-down mechanism described in U.S. Pat. No. 4,142,384. The mechanism can also be modified relatively easily to alter the frequency and the extent of the stroke of the sleeve 6 for different applications.

We claim:

1. In a circular knitting machine having at least a first revolving knitting cylinder, knitting cam means being located peripherally of the cylinder, an improved take-down mechanism comprising:

a take-down throat located inside of the cylinder;

a pair of take-down members, each of said take-down members having an annular resilient cup arranged concentrically with respect to said take-down throat;

take-down cam means for reciprocating said resilient cups toward and away from said take-down throat; and means for revolving the take-down cam means at a speed different from that of the first knitting cylinder.

2. A take-down mechanism for a circular knitting machine as claimed in claim 1 wherein the knitting machine includes a second revolving knitting cylinder superimposed on the first cylinder and knitting cam means are located peripherally of respective of the knitting cylinders, said improved take-down mechanism further comprising keying means for mounting the said pair of take-down members concentrically inside one of the cylinders whereby said take-down members revolve with said one cylinder, said cam means permitting independent axial sliding movement of the said take-down members; and a mounting member for rotatably mounting the take-down cam means; and wherein the means for revolving the take-down cam means at a speed different form that of the cylinder comprises a rotary back shaft of the knitting machine, said back shaft rotating at the speed of revolution of said one cylinder, and cooperating gears on the back shaft and the take-down cam means, said gears having a gear ratio which causes the take-down cam means to revolve at a speed slower than the speed of revolution of the knitting cylinders.

3. A take-down mechanism for a circular knitting machine as claimed in claim 2 further comprising suction means for removing knitting fabric upwardly through the innermost of the take-down members of said pair.

4. A take-down mechanism for a circular knitting machine as claimed in claim 1 wherein the take-down throat has an interior cup engaging face, said face including a pair of inclined conical wall portions spaced by a step, the cups respectively facing a cooperating one of the take-down throat conical wall portions to engage fabric between the cups and the side wall portions, and wherein each of the said take-down members of said pair of members supports a pair of cam followers, and wherein the take-down cam means has a pair of lobes for successively elevating each of the take-down members from a lowermost position wherein its associated cup is pressed down into its cooperating throat conical wall portion to a position clear of the cup engaging face of the throat.

5. A circular knitting machine as claimed in claim 4 wherein the take-down members are not associated with resilient means for biassing them downwards, the members being urged downward by gravity for engaging the fabric between their cups and the associated conical wall portion.

6. A circular knitting machine as claimed in claim 1 wherein the revolving means revolves the take-down cam means at approximately half of the speed of the cylinders.

7. Circular knitting machine having a pair of superimposed revolving knitting cylinders, a pair of knitting cam means arranged peripherally of the respective cylinders; a take-down throat inside of and engaging with one of the cylinders; a pair of concentrically arranged sleeves each having annular resilient cups inside of the other one of the cylinders, said cups facing the take-down throat; keying means between the sleeves and the other one of the cylinders to ensure their conjoint rotation but permitting independent axial sliding movement of the sleeves inside said other cylinder; cam followers including diametrically opposed rollers on each of said sleeves; take-down cam means having a pair of lobes for engaging said cam followers; means rotatably mounting said take-down cam means; a back shaft for revolving the other one of the cylinders at the same speed as said one cylinder; drive means interconnecting the back shaft and the take-down cam means to revolve the said cam means at a speed slower than that of the cylinders.

8. Circular knitting machine as claimed in claim 7 wherein air suction means is provided for removing knitted fabric through the innermost sleeve.

9. Circular knitting machine as claimed in claim 7 wherein the throat has on its interior, cup engaging face, a pair of steeply inclined conical wall portions spaced by a step, the respective cups face an appropriate one of the conical wall portions to engage fabric between the cups and the wall portions, the cam followers are urged towards the take-down cam means without resilient bias, and the cam lobes have a height sufficient to just clear the respective cups from the associated cup engaging wall portion of the throat.

10. A method of providing fabric take-down on a circular knitting machine having a revolving knitting cylinder with needles operated by a stationary knitting cam system and with a take-down throat which method involves sequentially reciprocating a pair of cups facing the take-down throat by take-down cam means revolving at a speed different from that of the cylinder, the frequency of reciprocation of each individual cup being substantially one per cylinder revolution, the downward travel of the cups being limited by engagement of the appropriate cup on the throat with the fabric therebetween under the influence of gravity and the upward travel of the cups being limited by the stroke of the take-down cam means arranged to just lift the respective cups clear of the fabric.

* * * * *